United States Patent [19]

Flavell

[11] 4,261,562

[45] Apr. 14, 1981

[54] ELECTROMAGNETICALLY REGULATED EXERCISER

[76] Inventor: Evan R. Flavell, 841 Solano Ave., Albany, Calif. 94706

[21] Appl. No.: 972,339

[22] Filed: Dec. 22, 1978

[51] Int. Cl.[3] ..... A63B 21/24

[52] U.S. Cl. ..... 272/129

[58] Field of Search ..... 272/73, 129, 125, DIG. 6

[56] References Cited

U.S. PATENT DOCUMENTS

| | | | |
|---|---|---|---|
| 3,765,245 | 10/1973 | Hampl | 272/73 |
| 4,082,267 | 4/1978 | Flavell | 272/129 X |

*Primary Examiner*—George J. Marlo

*Attorney, Agent, or Firm*—Owen, Wickersham & Erickson

[57] ABSTRACT

An electromagnetically regulated exerciser providing a variable proportioned resistance to the exercising user. A user input device is drivingly connected to a rotatable shaft. Permanent magnets mounted on the shaft rotate within a wound stator. The windings of the stator are electrically loaded by an electronic controller to create proportioned isokinetic exercise resistance. Motion of the input device by the user is opposed by dynamic braking forces generated by the electrical loading device, and the resistance increases proportionally as the user exceeds a preselected reference speed, effectively regulating user induced motion generally at the preselected reference speed.

6 Claims, 4 Drawing Figures

ELECTROMAGNETICALLY REGULATED EXERCISER

BACKGROUND OF THE INVENTION

The present invention relates generally to isokinetic or speed-regulated exercise apparatus, and more particularly to improvements in devices wherein the exercise resistance is provided via electrical generation and absorption means.

A simple and effective exerciser utilizing variable resistance means comprising an electrical generator and means for loading the output of the generator is described in my U.S. Pat. No. 4,082,267. Others have also used generators for similar purposes. However, such direct-current generators utilized in exercising equipment can develop certain problems, and the present invention is directed to improvements which will eliminate these problems.

In the standard construction of such a generator, a permanent magnetic field surrounds a rotating wound armature. To carry the current generated in the windings of the armature out of the generator, a system of brushes and commutator, or, minimally, brushes and slip rings is required. These components are subject to contamination and wear in use, and must be expensively constructed for long-term service under heavy use in an exerciser.

Also, in the standard generator construction, as the current-carrying windings are part of the rotating armature, the capacity of the generator is severely limited by the lack of an efficient thermal pathway to dissipate heat generated in these windings. Disproportionately large and expensive generators of this type are therefore required to provide the exercise resistance in exercisers for the larger and stronger muscle groups of the body. Alternatively, auxiliary cooling devices, such as fans, must be incorporated to carry away the excess heat generated by the device.

A partial solution to these difficulties in the construction of an inexpensive electromagnetically regulated exerciser was suggested in U.S. Pat. No. 3,984,666 to Barron. In that patent, an automotive type alternator was utilized as the exercise resistance producing means. In the standard construction of such an alternator, the current carrying windings are located in the stator or external stationary shell of the device, allowing efficient dissipation of the heat generated therein, either directly into the surrounding ambient, or to a heat sink. However, extensive external electronic circuitry is required to control the windings of the rotor, and external power must be applied thereto to generate the required magnetic field. While the major currents of the stator windings may be carried directly out of the device, brushes and slip rings are still utilized to power the windings of the rotor. It may be seen that while the utilization of a conventional alternator instead of a conventional D.C. generator in an exercise device to produce the exercise resistance may improve the thermal characteristics of the system, it substantially complicates the associated controller circuitry required, and increases the overall manufacturing cost of the apparatus.

It is therefore a primary object of the present invention to improve upon prior devices in the provision of an electromagnetically regulated exerciser wherein a variable exercise resistance is provided by an electrical generator having high thermal dissipation capacity and direct electrical connections to the current carrying windings, while requiring minimum associated control circuitry and no external excitation power.

SUMMARY OF THE INVENTION

In the present invention, an exercising user drives a speed regulated resistance mechanism through a user interface. The resistance mechanism comprises an electrical generator and an electronic controller for loading the output of the generator. The electrical generator is constructed of a permanent magnet rotor and a multiphase wound stator. The electronic controller loads the output of the generator in such a manner as to automatically vary the exercise resistance in proportion to the force applied by the exercising user.

Exercise apparatus and methods which incorporate the structure and techniques described above and which are effective to function as described above constitute specific objects of this invention. Other objects, advantages, and features of my invention will become apparent from the following detailed description of a preferred embodiment taken in conjunction with the accompanying drawings.

DESCRIPTION OF PREFERRED EMBODIMENTS

Figure 1:
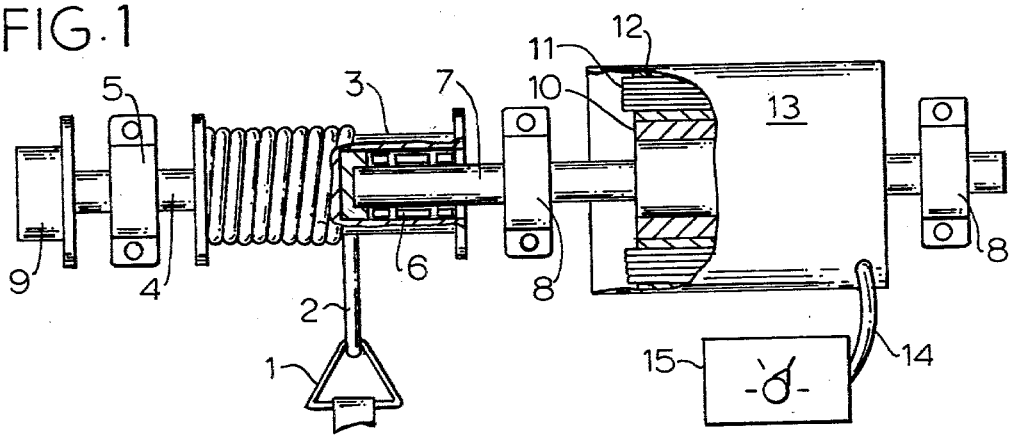
FIG. 1 is a view in elevation of a preferred embodiment of the invention.

An exerciser constructed in accordance with one embodiment of the present invention is shown in FIG. 1. Here, a stirrup handle 1 is provided for the user to grip with his hand and which he pulls in any desired manner to obtain exercise from the device. The handle 1 is connected through a cable 2 to a rotatable spool 3 about which the cable 2 is wound. The spool 3 is fixedly mounted at the one end on a shaft 4 which is supported by and free to rotate within bearing 5 which may be of the pillow block type indicated. More than one handle, cable, and spool may be provided if it is desired to involve more than one limb in exercising. For multiple exercising inputs, see, for example, my U.S. Pat. No. 4,082,267.

The other end of the spool 3 is coupled to a drive shaft 7 via a one-way clutch/bearing 6 such that it is free to rotate on the drive shaft 7 in the recoil direction, but is directly coupled to, and transmits rotation to, the drive shaft 7 in the opposite, or power direction of rotation. The drive shaft 7 is supported by and free to rotate within bearings 8, which may also be of the pillow block type. In this embodiment of the invention, the clutch/bearing 6 is shown to be of the type FCB manufactured by the Torrington Co., of Torrington, Connecticut. Any of a variety of mechanisms well known to those skilled in the art might serve the function, however, such as a wrap spring clutch, roller clutch, sprag clutch, or dog-and-pawl device used in combination with a bearing.

The spool 3 is also connected to a power spring mechanism 9 via the shaft 4 which functions to constantly urge the spool 3 in the recoil direction of rotation, thereby winding the cable 2 on the spool 3 when the user permits recoil. The power spring 9 may include a spiral, helical, or other well known type of torsion spring.

It may be seen that when the exercising user pulls on the handle 1, the cable 2 unwinds from the spool 3 causing it to rotate in the power direction, which rotation is transmitted to the drive shaft 7 via the clutch 6. When the user ceases to pull on the handle 1, the power spring mechanism 9 causes the spool 3 to rotate in the opposite direction, recoiling the cable 2 onto the spool 3. Rotation in the recoil direction, however, is not transmitted to the drive shaft 7 by the clutch 6.

Fixedly mounted on the drive shaft 7 are permanent magnets 10, which may be composed of well-known magnetic materials such as Alnico, ceramic, or rare-earth composite. The magnets rotate with the drive shaft 7. Surrounding the drive shaft 7 and magnets 10 are a series of windings 11 wound in the winding slots of a stator 12, which may be of iron laminate construction. The windings 11 are wound and connected in one of several manners well known to those skilled in the art so as to produce an alternating-current output in response to rotation of the magnetic field produced by the magnets 10. For example, the windings may be wound and connected in the three-phase "delta" or "Y" configuration commonly used in the manufacture of automotive type alternators. The stator 12 is supported by a housing 13 which is suitably mounted so as to prevent rotation of the stator 12.

The windings 11 are connected to an electronic controller 15 via an electrical cable 14. Details of the construction of the electronic controller 15 are shown in the schematic diagram of FIG. 2. Here, the windings 11 are connected in the three-phase "Y" configuration. The alternating-current outputs of the windings 11 are converted to direct current by the three-phase full-wave bridge rectifier 16. The waveform of the direct current output of the bridge rectifier 16 is not perfectly "flat", but, for the purposes of the present invention may be considered to be a direct-current voltage. It may be seen that this voltage is proportional to the speed of rotation of the permanent magnets 10 of FIG. 1 and therefore to the speed of movement of the exercising user in the power direction of movement of the apparatus.

As the speed of the user-induced motion of the device causes the output voltage of the bridge rectifier 16 to approach a value established by the selection of none, one, or more voltage reference elements 17 (here shown to be zener diodes) via selector switch 18, current begins to flow through a series resistance 19 and a variable shunt element 20, which may comprise Darlington connected power transistors. A larger number of voltage reference elements 17 may be provided, so that the switch 18 can select from among a wide range of voltage reference values.

It may be seen that any increase in speed of motion in the power direction of movement of the device above that corresponding to a voltage output equivalent to that of the selected voltage reference can only occur via the user's overcoming a proportional increase in the dynamic braking forces created by increased current flowing in the windings 11, since the variable shunt element 20 maintains the voltage output of the bridge rectifier 16, and therefore of the windings 11, substantially in accordance with the voltage reference selected by the selector switch 18. Depending upon the position of the selector switch 18, none, one, or more of the voltage reference elements 17 may be in the circuit, allowing the selection of several operating speeds for the apparatus.

Figure 2:
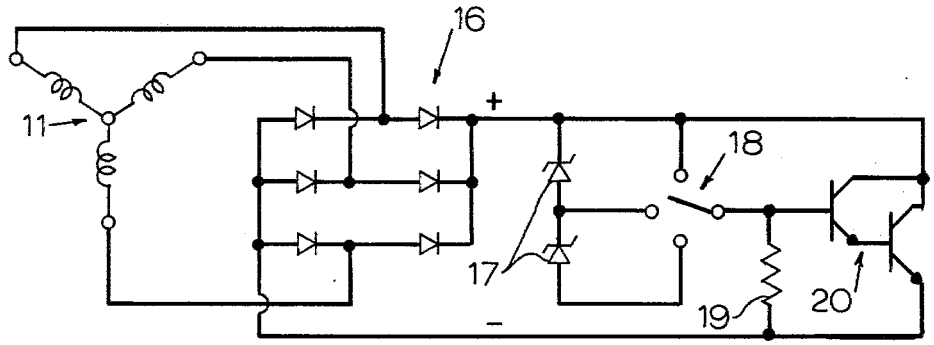
FIG. 2 is a simplified schematic diagram of the control electronics of the apparatus shown in FIGS. 1, 3 and 4.

Thus, the components of FIG. 2 regulate the speed of the exercise apparatus by increasing and decreasing dynamic braking forces in opposition to and in proportion to user-induced speed increases and decreases above a selected regulation speed. Many alternative control means for varying the electrical loading of the windings 11 of the device will be apparent to those skilled in the art. See, for example, my U.S. Pat. No. 3,869,121 and my U.S. Patent Application Ser. No. 808,729, co-opening herewith. If desired, the exercising system may include a performance display readout as described in my U.S. Pat. No. 3,848,467.

Figure 3:
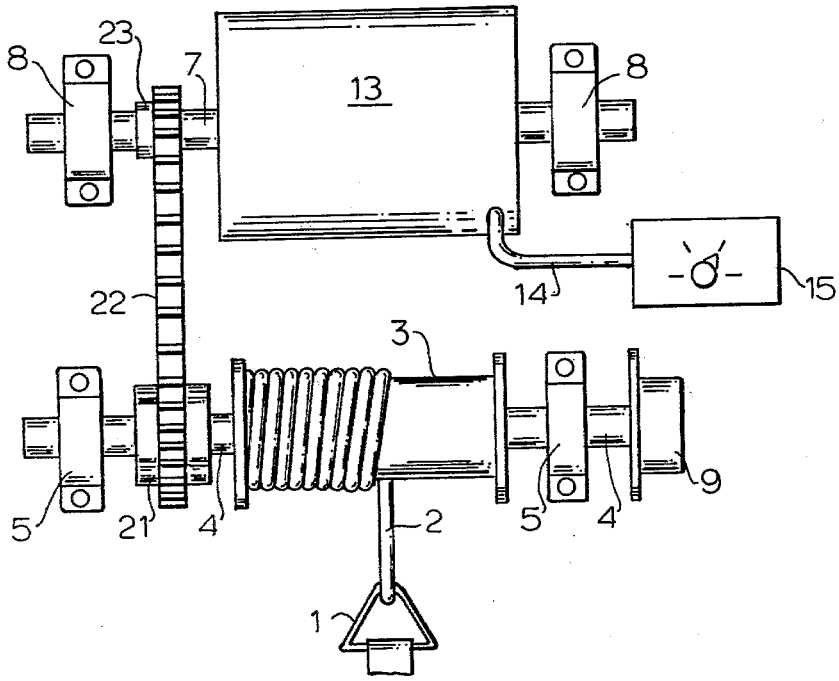
FIG. 3 is a view in elevation of a second embodiment of the invention.

In certain applications of the present invention, it may not be desirable to directly couple the user input to the drive shaft 7 as shown in FIG. 1. For example, at the sacrifice of highest possible speed of operation, it may be desirable to multiply the dynamic braking force capability of the apparatus via power transmission means, such as is shown in FIG. 3. Here, the spool 3 is fixedly attached to the shaft 4. A one-way clutch/bearing (not shown) similar to 6 of FIG. 1 is mounted in the hub of a large sprocket 21, such that the shaft 4 is free to rotate in the sprocket 21 in the recoil direction, but is directly coupled to, and transmits rotation to, the sprocket 21 in the opposite, or power direction of rotation. The shaft 4 is supported by and free to rotate within bearings 5, and is constantly urged in the recoil direction by a power spring 9.

The large sprocket 21 is connected via a roller chain 22 to a small sprocket 23, which is fixedly attached to the drive shaft 7. The drive shaft 7 is supported by and free to rotate within bearings 8. Mounted on the drive shaft 7 are permanent magnets (not shown) similar to the magnets 10 of FIG. 1, which, when rotating with the drive shaft 7, generate an alternating current in the stator windings (not shown) contained within the housing 13. The windings are connected via an electrical cable 14 to an electronic controller 15, such as is described with reference to FIG. 2. It may be seen that, for each rotation of the shaft 4 in the power direction of rotation, the drive shaft 7 is caused to make multiple rotations according to the ratio of the sprockets 21 and 23; and the dynamic braking forces applied by the apparatus against the exercising user are multiplied proportionately. In certain applications, it may be desirable to reduce the braking force capability of the apparatus and increase the maximum useable speed of the device. Reversing the large and small sprockets would accomplish this, reducing the force proportionately. Thus, the capacity of the apparatus may be adjusted according to the requirements of particular applications via mechanical power transmission means. Although chain and sprocket power transmission means are shown here, other well-known types of drive mechanisms might serve as well, such as timing belt and pulleys, gear drive, hydraulic drive, etc.

Figure 4:
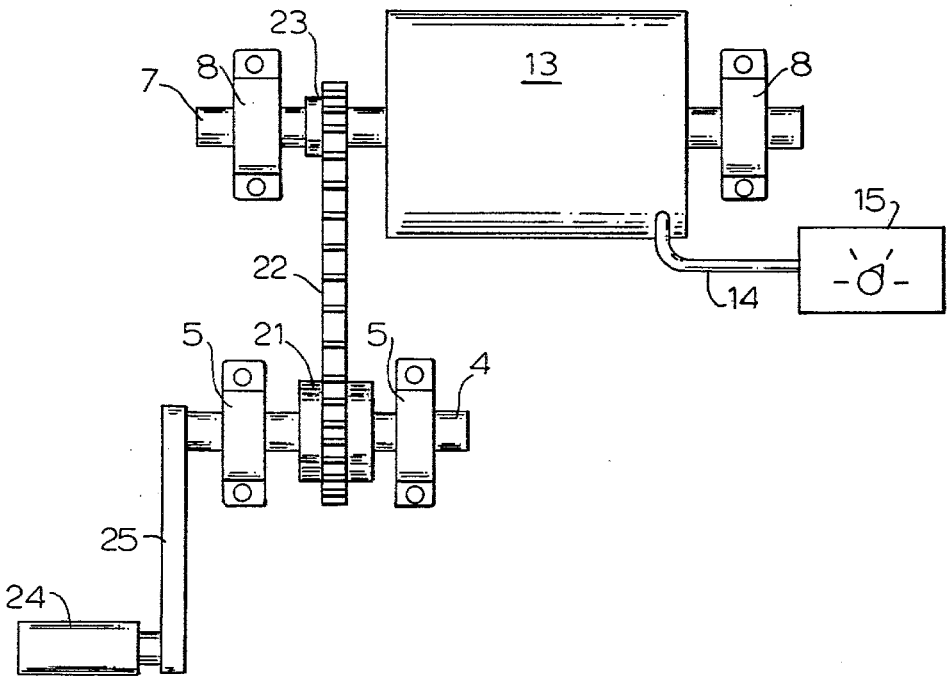
FIG. 4 is a view in elevation of a third embodiment of the invention.

FIG. 4 shows a third embodiment of the invention. Here, a handle 24 is attached to a lever arm 25, which is fixedly mounted to the shaft 4. Also fixedly mounted on the shaft 4 is a large sprocket 21 which is linked via a roller chain 22 to a small sprocket 23 fixedly mounted on the drive shaft 7. The shaft 4 and drive shaft 7 are supported by and free to rotate within bearings 5 and 8, respectively. In this embodiment of the invention there is no one-way clutch. Power is transmitted to the drive shaft 7 in both directions of rotation, and the lever arm 25 may be moved by the exercising user in either a reciprocal fashion or in a continuous manner in either direction of movement against the dynamic braking forces generated by the magnets (not shown) mounted on the drive shaft 7 and the stator windings (not shown) contained within the housing 13. Resistance is controlled by the electronic controller 15 (as described above, for example), which is connected to the windings via the electrical cable 14. Thus, the apparatus may be easily adapted to suit a variety of exercise applications.

Various combinations of the structures and techniques of the embodiments of FIGS. 1–4, and many and varied applications of this electromagnetic exerciser will suggest themselves to those skilled in the art. For example, the apparatus of FIGS. 1–4 might be combined to construct a bicycle exerciser (not shown). Here, a suitably constructed frame would support the housing 13, bearings 5 and 8, and shafts 4 and 7 of FIG. 4. The shafts 4 and 7 would be drivingly connected by a power transmission means comprising sprockets 21 and 23 and roller chain 22. A second lever arm 25 would be attached to the opposite end of the shaft 4 of FIG. 4, oriented 180° to the first lever arm 25, and foot pedals would substitute for the gripping handle 24. Located within the hub of one of the sprockets 21 and 23 might be a one-way clutch/bearing 6 as described in FIG. 3 and shown in FIG. 1, although the device could have a direct drive, for exercising in both directions or rotation, if desired.

To obtain exercise from the device, the user would mount the frame, placing his feet on the pedals attached to the lever arms 25, and apply force to the pedals in the power (forward) direction of rotation, which rotation would be transmitted to the shaft 4, and, via the chain 22 and sprocket 21, 23 power transmission and one-way clutch 6 to the drive shaft 7. Since permanent magnets 10 are mounted on the drive shaft 7, user movement of the pedals of the bicycle translates into rotation of a magnetic field within the stator 12, generating an alternating current potential in the windings 11 thereof. The alternating current output of the windings 11 is rectified to pulsating direct current by the bridge rectifier 16. It may be seen that the user may pedal the bicycle at any speed less than that corresponding to the voltage reference 17 selected by the selector switch 19 essentially unopposed by the device, that is, the user may easily accelerate the apparatus to the preselected regulation speed, being opposed only by the inherent friction and inertia of the various moveable components.

Once the exercising user achieves the preset regulation speed, however, further acceleration of the device is opposed by dynamic braking forces generated by current flowing in the windings 11 and shunt element 20, as the shunt element 20 maintains the output voltage of the windings 11 substantially in accordance with the selected reference voltage. Above the preselected reference speed, increased force applied by the user is opposed by proportionately increasing dynamic braking forces generated by the apparatus, according to the relationship:

$$R_g = \Delta T/\Delta n = K_E K_T/R$$

where:

$R_g$ = the regulation constant of the system
n = rotational speed
T = torque
R = winding resistance
$K_E$ = voltage constant, and
$K_T$ = torque constant.

Thus, the bicycle exerciser described above provides the exercising user with an exercise resistance automatically proportioned to the level of intensity of his efforts to move the device in the power (forward) direction at speeds exceeding the preset regulation speed. Should the user desire to slow or stop moving the pedals, or to pedal in the opposite direction, the one-way clutch 6 disengages the shaft 4 from the drive shaft 7, and the pedals are free to slow, stop, or rotate in the opposite direction, much as is characteristic operation of a conventional bicycle. At any time, the user may resume pedaling the device in the forward direction to obtain exercise as desired, or as directed by a trainer or therapist to achieve the desired training objective.

The following advantages are among those obtained by the present invention:

(1) A high thermal dissipation capacity is achieved via stationary current-carrying windings, which may be efficiently cooled. Prior devices constructed with conventional direct current generators having wound rotating armatures were limited in their application to the purpose by poor thermal pathways necessitating oversized construction or expensive auxiliary cooling means.

(2) Stationary windings may be directly connected to external electronic control components, eliminating the need for brushes, commutators, or slip rings, which, in prior devices, were subject to wear and contamination, and contributed unnecessarily to the expense of fabrication.

(3) A permanent magnet rotor eliminates the need for external excitation power and circuitry to create the required magnetic field. The need for brushes and slip rings to carry excitation power to a wound rotor as in prior alternating current generator devices is eliminated in the present invention.

(4) Using recently developed low-mass, high-strength permanent magnet materials such as samarium cobalt, exercisers constructed according to the techniques of the present invention may be significantly smaller in size and lower in inertia than with the conventional structures, thereby minimizing the contribution of rotor inertia to system exercise resistance.

(5) Exercisers manufactured according to the structures of the present invention are well suited for use in explosive or flamable atmospheres, as the elimination of brushes and slip rings prevents dangerous arcing of contracts. Devices of the new construction would find application in spacecraft, for example.

(6) Preferred combinations of components for accomplishing these objectives are neither complex nor expensive to manufacture.

To those skilled in the art to which this invention relates, these and other advantages of this electromagnetically regulated exerciser will be apparent. Many changes in construction and widely differing embodiments and applications will suggest themselves without departing from the spirit and scope of the invention. The disclosures and the description herein are purely illustrative and not intended to be in any sense limiting.

I claim:

1. An exercising apparatus, comprising:

a user-engagable input means;

a movable permanent magnetic field, including at least one permanent magnet and means mounting the magnet for movement;

a driving connection between the input means and the mounting means of the permanent magnetic field;

a wound stator associated with and positioned within the permanent magnetic field, and means mounting the wound stator fixedly so that the movable permanent magnetic field moves relative to the stator; and electrical loading means connected to the windings of the stator for loading the electrical output thereof, including controlled power semiconductor means connected to the windings of said wound stator, and control means connected to said power semiconductor means for controlling said semiconductor means, said control means including means responsive to the speed of movement of the movable permanent magnetic field for providing a proportioned resistance to user exercising movement above a preselected reference speed, whereby motion of the input means by the exercising user is opposed by dynamic braking forces generated by the electrical loading means, and the resistance increases proportionally as the user exceeds the preselected reference speed, effectively regulating user-induced motion generally at said preselected reference speed.

2. The exercising apparatus of claim 1 wherein said control means includes means for adjusting said preselected reference speed.

3. An exercising apparatus, comprising:

a user-engagable input means;

a movable permanent magnetic field, includng at least one permanent magnet and means mounting the magnet for movement;

a driving connection between the input means and the mounting means of the permanent magnetic field;

a wound stator associated with and positioned within the permanent magnetic field, and means mounting the wound stator fixedly so that the movable permanent magnetic field moves relative to the stator; and electrical loading means connected to the windings of the stator for loading the electrical output thereof, including control means responsive to the speed of movement of the permanent magnetic field for providing a proportioned resistance to user exercising movement above a preselected reference speed, whereby motion of the input means by the exercising user is opposed by dynamic braking forces generated by the electrical loading means, and the resistance increases proportionally as the user exceeds the preselected reference speed, effectively regulating user-induced motion generally at said preselected reference speed.

4. The exercising apparatus of claim 3 wherein said control means includes means for adjusting said preselected reference speed.

5. An electronmagnetically regulated exercising device, comprising:

frame means;

a user-engageable input means having a rotatable member mounted on the frame means;

a rotatable shaft supported by the frame means, and a driving connection between the input means and the shaft;

permanent magnets mounted on the shaft for rotation therewith, forming a movable permanent magnetic field;

a wound stator mounted fixedly on the frame means, generally circumjacent the permanent magnets and positioned within the permanent magnetic field; and electrical loading means connected to the windings of the stator for loading the electrical output of the stator, including control means responsive to the speed of movement of the permanent magnetic field for providing a proportioned resistance to user exercising movement above a preselected reference speed;

whereby user-induced motion of the input means is opposed by dynamic braking forces generated by the electrical loading means, and the speed of the user-induced motion is effectively regulated generally at said preselected reference speed.

6. The electromagnetically regulated exercising device of claim 5 wherein said control means includes means for adjusting said preselected reference speed.

* * * * *